US005261309A

United States Patent [19]

Valen

[11] Patent Number: 5,261,309

[45] Date of Patent: Nov. 16, 1993

[54] WEAR PAD ASSEMBLY ATTACHABLE TO DRUM STRUCTURE

[76] Inventor: Jonathan Valen, 1309 Amherst, #210, West Los Angeles, Calif. 90025

[21] Appl. No.: 710,464

[22] Filed: Jun. 5, 1991

Related U.S. Application Data

[63] Continuation-in-part of Ser. No. 665,273, Mar. 6, 1991, Pat. No. 5,121,666.

[51] Int. Cl.[5] ..... G10D 13/02

[52] U.S. Cl. ..... 84/453; 84/411 R

[58] Field of Search ..... 84/453, 411 R, 411 A, 84/411 M, 415, 452 P

[56] References Cited

U.S. PATENT DOCUMENTS

| | | | |
|---|---|---|---|
| 312,804 | 2/1885 | Brown | 84/453 |
| 504,910 | 9/1893 | Cox | 84/411 R |
| 772,743 | 10/1904 | Oschatz | 84/411 R |
| 2,779,227 | 1/1957 | Slingerland, Jr. | 84/411 R |
| 3,981,220 | 9/1976 | Clark | 84/415 |
| 4,283,985 | 8/1981 | Famularo | 84/411 R |
| 4,344,349 | 9/1982 | Cordes | 84/411 R |
| 5,121,666 | 6/1992 | Valen | 84/453 |

*Primary Examiner*—Michael L. Gellner
*Assistant Examiner*—Cassandra Spyrou
*Attorney, Agent, or Firm*—William W. Haefliger

[57] ABSTRACT

A drum stick wear pad assembly associated with drum structure including an arcuate rim, comprising: a non-metallic relatively hard pad elongated with primary curvature in the length direction of the drum arcuate rim; a rigid mount for the pad to hold the pad presented outwardly above and adjacent the rim; and the mount configured to be attachable to the drum structure in spaced relation to the rim.

25 Claims, 3 Drawing Sheets

WEAR PAD ASSEMBLY ATTACHABLE TO DRUM STRUCTURE

BACKGROUND OF THE INVENTION

This application is a continuation-in-part of Ser. No. 665,273 file Mar. 6, 1991 now U.S. Pat. No. 5,121,666.

This invention relates generally to prevention of drum stick breakage or excessive wear, due to impact against drum metallic rims. More particularly, it concerns a highly advantageous, simple, easily attached wear pad assembly to be struck by drum sticks, and easily attachable to and removable from a drum at the rim thereof.

The problem of drum stick wear and breakage is substantial. The more breakage that occurs, the more cost is involved in replacing them. Such wear and breakage occurs and persists primarily as a result of impacts against the drum rim, for "rim shot" acoustical effects, which are desirable. There is need for means attachable to a drum that will minimize such wear and breakage problems, while retaining the acoustical effects of rim shots and while allowing "playing" of the drum in the same manner as before.

SUMMARY OF THE INVENTION

It is a major object of the invention to provide a drum wear pad assembly that is constructed and operated in such manner as to overcome the described problems. As will be seen, the assembly herein described solves the problem and also provides additional advantages in construction, mode of operation (including connection to the drum) and results.

Basically, the present drum stick wear pad assembly is attachable to a drum rim, and includes a) a non-metallic relatively hard pad elongated with primary curvature in the length direction of the drum arcuate rim, b) a rigid mount for the pad to hold the pad presented outwardly above the rim, c) the mount configured to be attachable to the drum structure in spaced relation to the rim.

As will be seen, the pad typically may have secondary curvature to extend over the top of the drum rim; and for this surface the pad may have inverted U-shaped cross-sections in planes normal to lengthwise extent of the pad in the primary curvature direction. The pad itself may advantageously consist of hard leather, closely acoustically coupled to the mount which is metallic and acoustically coupled to the rim, whereby drum stick striking of the pad transmits shock waves to the metallic rim to produce "rim shot" acoustic effect.

Another object is to provide the mount to be elongated with primary curvature in the length direction of said arcuate rim, the mount supported on the rim; and the mount typically having inverted U-shaped cross-sections in planes normal to lengthwise extent of the mount. In this regard, the pad typically also has inverted U-shape, and is attached to the mount, whereby the pad fits closely over the inverted U-shape of the mount.

A further object is to provide the mount with an angled foot attachable to the drum, the foot typically attachable to a drum clamp such as a tuning rod, and a drum flange, to hold the mount in tight engagement with the rim, for acoustic coupling as referred to.

Yet another object is to provide, in combination with the arcuate rim of a drum, the improvement comprising:

a) a drum stick wear pad mounted on said rim, b) said pad consisting of non-metallic relatively hard material, elongated with primary curvatures in the length direction of the arcuate rim.

That hard material may typically consist of synthetic resin, (for example polypropylene, polyurethane, PVC, polycarbonate and elastomers) and in one form of the invention the resin is bonded to the rim, as by rim contact with resin plastisol, subsequently cured in situ. The band may extend to the rim terminal and to opposite side surfaces of the metallic rim.

Yet another object is to provide a separately molded synthetic resin wear pad structure having an upper portion to extend over the tip of the rim, and a foot structure spaced from that upper portion, to attach to the drum.

Further objects include the process of the wear pad to extend part way about the annular extent of the rim, or alternatively substantially completely about the rim.

These and other objects and advantages of the invention, as well as the details of an illustrative embodiment, will be more fully understood from the following specification and drawings, in which:

DRAWING DESCRIPTION

DETAILED DESCRIPTION

Figure 1:
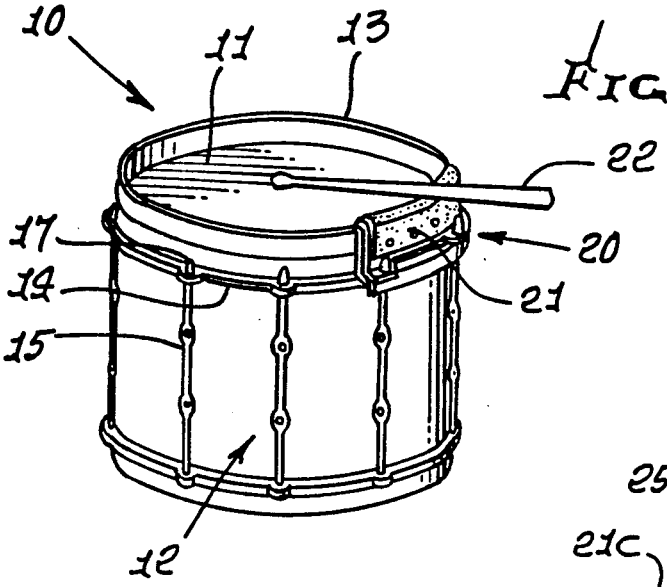
FIG. 1 is a perspective fragmentary view of a drum to which the invention is applied.
Figure 2:
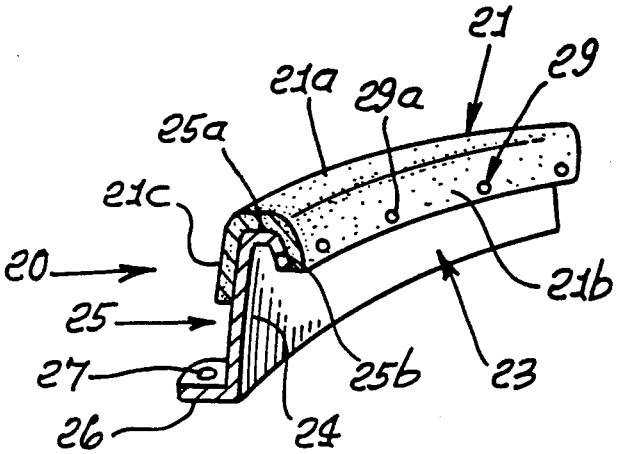
FIG. 2 is an enlarged perspective view of the wear pad assembly.

In the drawings, a drum 10 has a head 11, a shell or body 12, and a metallic annular rim 13. Projecting outwardly from the shell or body is a flange or flanges 14, below the level of the rim. Tuning key rods 15 extend parallel to the shell 12, and project through openings 16 in the flange or flanges. Tuning keys 17 have stems thread-connected to the rods, and may be tightened or loosened, to vary loading on the drum.

The wear pad assembly 20 of the invention is attachable to the drum structure, including the arcuate (annular) metallic rim 13. The assembly basically includes a non-metallic, relatively hard pad 21, elongated with primary curvature in the length direction of the arcuate rim. Thus, the pad may extend (along the rim) circularly, at a radius R, indicated in FIG. 4, from the drum axis. The pad may advantageously consist of hard leather, or hard leather with a thin rubber coat, on which a drum stick or sticks 22 strike, to minimize breakage of the sticks. Plastic material is also usable.

Figure 3:
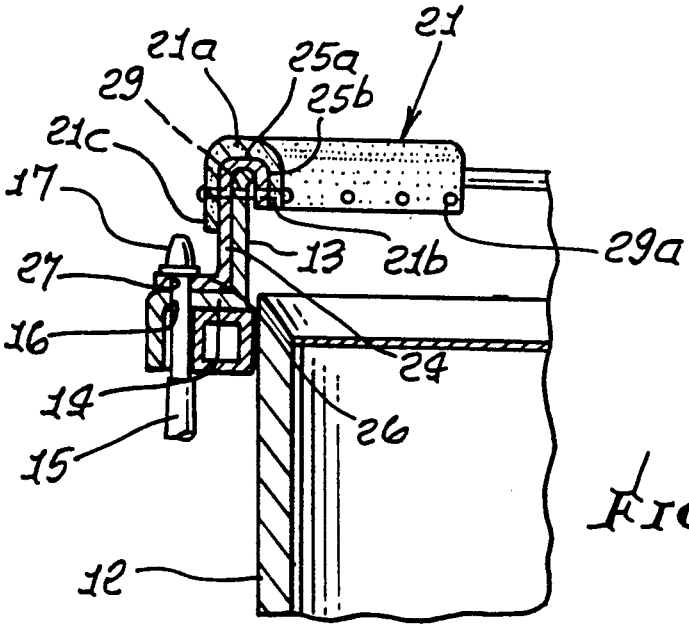
FIG. 3 is a vertical section taken through the FIG. 1 assembly.
Figure 4:
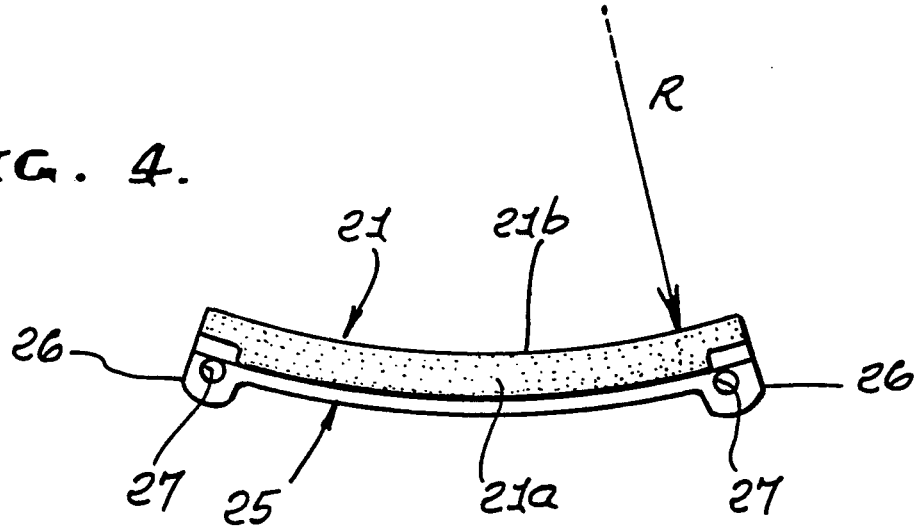
FIG. 4 is a plan view of the FIG. 2 assembly.
Figure 5:
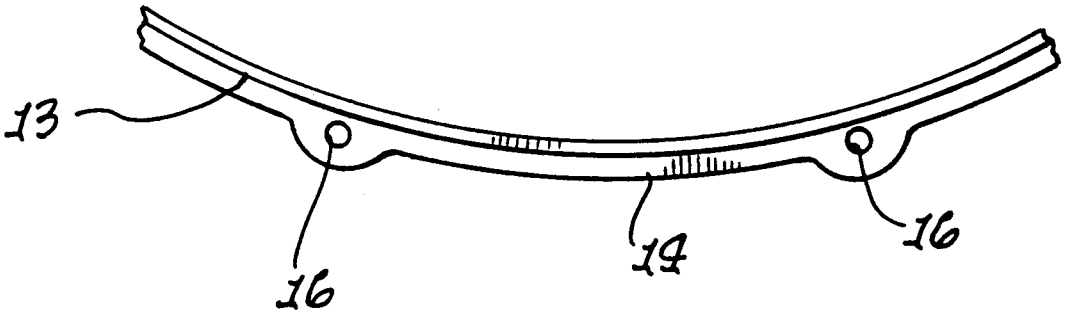
FIG. 5 is a plan view of a snare drum rim, to which the wear pad assembly is attachable.

A rigid mount, as for example at 23, is provided for the pad 21, to hold the pad presented outwardly from and above the rim; however, the mount acoustically couples the pad to the rim for desired "rim shot" acoustic effect, when struck by the stick 22. At the same time, the use of the pad minimizes wear on the drum stick or sticks 100 which impact the pad. The illustrated mount 23, typically metallic, (for example aluminum or other metal) includes a wall portion 24 extending upwardly generally parallel to rim 13 and closely adjacent the outer side of the rim. It also includes an upper "hook" portion 25 that hooks over the top of the rim as shown. See hook top ap and inner side **25*b*, whereby the portion 25 has inverted U-shape cross-sections in planes normal to lengthwise extent of the mount. (See the plane of FIG. 3, for example). The mount also includes a turned foot or flange 26, (or feet of flanges), that projects outwardly away from the rim at a location or locations adjacent the drum flange 14. The foot or feet define at least one through opening 27 registering with opening 16 or openings 16 in the flange. See FIGS. 4 and 5 showing two openings 16 in the flange. See FIGS. 4 and 5 showing two openings 27 that register with openings 16. Upon attachment of the mount to the drum, the tuning key stems pass through openings 16 and 27, and the keys 17 are tightened to clamp the foot or feet 26 to the flange or flanges 14, the mount then being acoustically coupled to the rim. Keys 17** therefore have multiple functions.

Pad 21 fits over the mount upper extent, and typically also has inverted U-shape to closely fit the mount hook portions **25*a* and 25*b*. See pad "hook" portions 21*a* and 21*b* respectively engaging 25*a* and 25*b*. The pad also has an outer wall 21*c* engaging mount wall 24, as shown, and fasteners 29 attach 21*b* to 25*b* to retain the pad closely acoustically coupled to the mount. Such fasteners have heads 29*a* engaging 21*b*** as shown.

Accordingly, the pad 21 and mount 23 both have primary curvature in the length direction of the arcuate rim; and both have inverted U-shape secondary curvature in planes normal to the rim lengthwise extent. The wear pad assembly typically has length between about 1 and 8 inches; however, it may extend to any selected lengths along the rim 13, as for example completely about the rim (360°), or only partly along and about the rim, the diameter being from 6 inches to 32 inches, as hereinafter referred to.

The invention may also take the form of a wear pad mounted on a drum rim, the pad consisting of non-metallic relatively hard material, elongated with primary curvature in the length direction of the arcuate rim. The pad may be injection molded and consist of synthetic resin.

Figure 6:
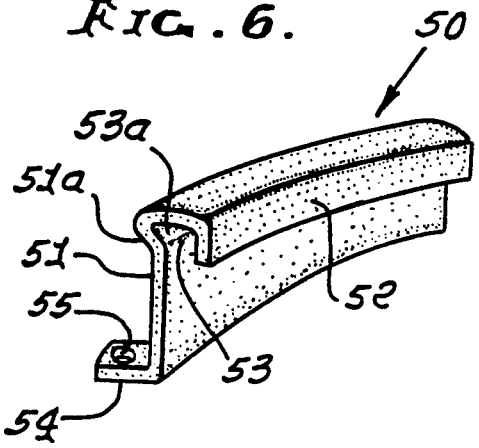
FIG. 6 is a view like FIG. 2 but showing a synthetic resin pad structure (triple flange rim)

FIG. 6 shows one such pad 50 (triple flange rim version) shaped to extend over the top of a drum rim. The pad has an upright side wall 51, a hook shaped upper portion 52 shaped to hook over the rim which then fits in channel 53, at one side of wall 51, and an integral foot 54 that projects away from the lowermost extent of the wall 51. The foot contains an opening 55 to pass a fastener, as seen in FIG. 3. The pad 50 has generally S-shape in cross-section, and consists of non-metallic hard material. One example is synthetic resin molded to have the shape shown. The pad is arcuate in the looping direction of the rim to fit over the rim, as in FIG. 3. The pad may extend part way along the rim, or substantially completely about and along the rim.

Figure 8:
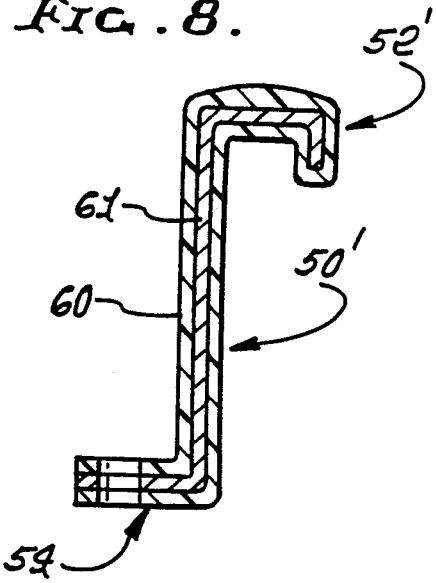
FIG. 8 is a section through a wear pad structure (as for a die cast rim) having a metallic core embedded in synthetic resin.

FIG. 8 shows another form of the pad 50', as in FIG. 6, consisting of a synthetic resin body 60 having a metallic core 61 embedded in that body. Both have substantial S-shape in cross-section, the core extending into foot 54' and into the pad hook shaped upper portion 52'. The FIG. 6 pad may or may not have a metallic core.

Figure 7:
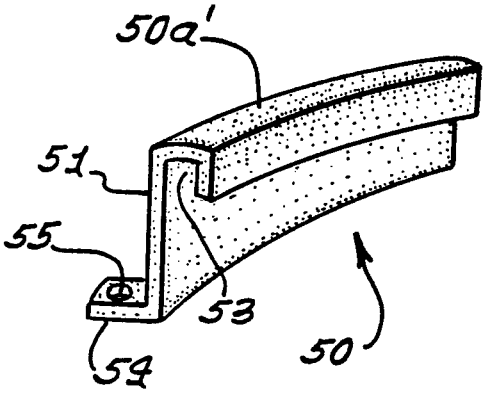
FIG. 7 is a view like FIG. 6 showing another form of pad structure (as for a die cast rim)

FIG. 7 shows a wear pad like that of FIG. 6, but wherein the side wall 51 is everywhere vertical. In FIG. 6, the upper extent of side wall 51 diverges at **51*a*, to provide the channel 53 with an offset at 53*a*. No such offset appears in FIG. 7. The upper surface 50*a* of the pad in FIG. 6 is wider than the upper surface 50*a'* in FIG. 7. The FIG. 7** pad may or may not have a metallic core.

Figure 9:
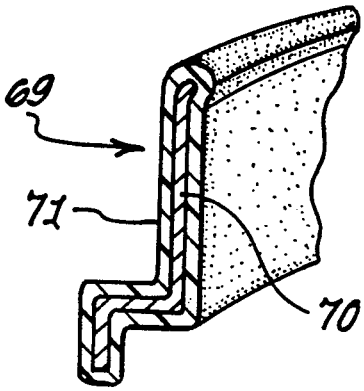
FIG. 9 is a section through a drum rim to which synthetic resin has been applied and bonded, to form a drum wear pad.

FIG. 9 shows a wear pad 69 consisting of synthetic resin contacting and covering the entirety of the drum rim 70 itself, the resin cured in situ and attached to the drum rim. The looping metal rim may be detached from the drum and dipped into resin plastisol or synthetic resin to form the pad "skin" 71. Thereafter, the covered rim is attached to the drum. Only the outermost extent of the rim may be dipped into the plastisol to form the pad, if desired.

This invention is applicable to all size drums, for example from 6 inches to about 32 inches, and to drums having any number of lugs.

Figure 10:
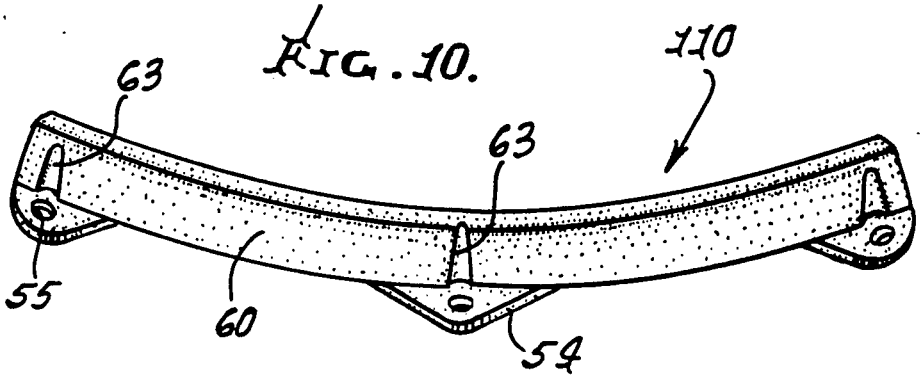
FIG. 10 is a perspective view showing a modified wear pad structure.

FIG. 10 shows a wear pad structure 110 of the type seen in cross-section in FIG. 8. The plastic coating or body 60 has side cut-outs 63 offset from fastener openings 55, to provide space for the shanks of fasteners that pass through the openings. Such cut-outs may be mold-formed, during molding of the resin about the core, or otherwise formed.

I claim:

1. A drum stick wear pad assembly attachable to a drum structure including a drum structure arcuate rim having a primary curvature, comprising:

a) a non-metallic, relatively hard pad with primary curvature corresponding to said primary curvature of said drum structure arcuate rim, the pad having a top surface, b) a rigid mount for the pad to hold the pad presented outwardly above and adjacent said drum structure arcuate rim, c) the rigid mount configured to be attachable to the drum structure in spaced relation to said drum structure arcuate rim, d) said rigid mount defining a foot spaced downwardly from said top surface, said foot defining a connection attachable to said drum structure to hold the pad in position relative to said drum structure arcuate rim.

2. The assembly of claim 1 wherein said drum structure arcuate rim has a top and said pad has secondary curvature to extend over the top of said drum structure arcuate rim.

3. The assembly of claim 2 wherein the pad has inverted, U-shaped cross-sections in planes normal to a tangent to said primary curvature of the pad.

4. The assembly of claim 1 wherein the pad is selected from a group consisting of:

i) leather
ii) hard rubber
iii) leather and hard rubber
iv) synthetic resin
v) plastic.

5. The assembly of claim 1 including said rum structure arcuate rim and wherein said rigid mount is directly supported on said drum structure arcuate rim.

6. The assembly of claim 5 wherein said mount has inverted, U-shaped cross-sections in planes normal to a tangent to said primary curvature of the pad.

7. The assembly of claim 6 wherein the mount is metallic.

8. The assembly of claim 6 wherein the pad fits over said U-shape of the mount.

9. The assembly of claim 8 wherein the pad also has inverted U-shape, and is attached to the mount.

10. The assembly of claim 9 wherein the pad is selected from a group consisting of:

i) leather
ii) hard rubber
iii) leather and hard rubber
iv) synthetic resin
v) plastic.

11. The assembly of claim 1 wherein the foot is angled to be attachable to a drum structure clamp via said connection.

12. The assembly of claim 11 including said drum structure clamp via which the foot is connected to said drum structure.

13. The assembly of claim 9 wherein the mount has inner and outer walls respectively engaging opposite sides of said drum structure arcuate rim, and the pad has inner and outer walls respectively engaging said mount inner and outer walls, and fastener means passing through the mount and the pad inner and outer walls to retain the pad in direct engagement with the mount.

14. The assembly of claim 1 wherein the pad consists of leather with a rubber coating thereon.

15. The assembly of claim 1 wherein the pad extends about four inches along said primary curvature of the pad.

16. The assembly of claim 15 wherein the pad extends along and about a substantial portion of said drum structure arcuate rim.

17. In combination with a rim of a drum, said rim having a top, the improvement comprising a) a drum stick wear pad mounted on said drum rim,
b) said pad consisting of non-metallic, relatively hard material, with primary curvature along said drum rim,
c) said pad extending over the top of said drum rim, and defining a foot spaced downwardly from said top of the drum rim, said foot attachable to the drum to hold the pad in position relative to the drum rim.

18. The combination of claim 17 wherein said material is bonded to said drum rim.

19. The combination of claim 17 wherein said material consists of synthetic resin applied to said drum rim by contact with resin plastisol and cured in situ to become bonded to said drum rim.

20. The combination of claim 17 wherein said drum rim has a terminal edge, and said material covers said edge, said drum rim also having opposite side surfaces covered by said material.

21. The combination of claim 17 wherein said material extends substantially completely about an annular loop defined by said drum rim.

22. The combination of claim 17 wherein said material extends less than one-half way about an annular loop defined by said drum rim.

23. The combination of claim 17 wherein said pad including said foot consists of molded synthetic resin.

24. The combination of claim 23 including a metallic core embedded in said synthetic resin.

25. The combination of claim 17 including a fastener having a shank, and wherein said pad includes a cut-out in lateral alignment with a hole in said foot, to accept a side of said fastener shank, the said fastener extending through the hole.

* * * * *